US005964127A

United States Patent [19]

Steingroever

[11] Patent Number: 5,964,127

[45] Date of Patent: Oct. 12, 1999

[54] PROCESS AND APPARATUS FOR MANUFACTURING METALLIC HOLLOW BODIES WITH STRUCTURAL BULGES

[75] Inventor: Erich Steingroever, Bonn, Germany

[73] Assignee: Magnet-Physik Dr. Steingroever GmbH, Germany

[21] Appl. No.: 09/057,607

[22] Filed: Apr. 9, 1998

[30] Foreign Application Priority Data

Apr. 12, 1997 [DE] Germany ..... 197 15 35 18

[51] Int. Cl.[6] ..... B21D 26/14

[52] U.S. Cl. ..... 77/56; 72/430; 29/419.2

[58] Field of Search ..... 29/419.2; 72/54, 72/56, 430

[56] References Cited

U.S. PATENT DOCUMENTS

| | | | |
|---|---|---|---|
| 3,126,937 | 3/1964 | Brower et al. | 72/56 |
| 3,214,511 | 10/1965 | Franklin | 29/419.2 |
| 3,321,946 | 5/1967 | Ferguson | 72/56 |
| 3,345,732 | 10/1967 | Brower | 72/56 |
| 4,523,872 | 6/1985 | Arena et al. | 29/419.2 |
| 4,702,543 | 10/1987 | Hager | 29/419.2 |
| 4,807,351 | 2/1989 | Berg et al. | 29/419.2 |
| 5,331,832 | 7/1994 | Cherian et al. | 72/56 |
| 5,353,617 | 10/1994 | Cherian et al. | 72/56 |
| 5,442,846 | 8/1995 | Snapper | 72/56 |
| 5,457,977 | 10/1995 | Wilson | 72/56 |
| 5,586,460 | 12/1996 | Steingroever | 72/56 |
| 5,684,341 | 11/1997 | Steingroever . | |
| 5,813,264 | 9/1998 | Steingroever | 72/56 |

FOREIGN PATENT DOCUMENTS

| | | |
|---|---|---|
| 23 30 479 | 12/1976 | Germany . |
| 44 23 992 | 7/1994 | Germany . |
| 44 23 992 C2 | 9/1995 | Germany . |
| 44 36 615 A1 | 4/1996 | Germany . |

*Primary Examiner*—David Jones
*Attorney, Agent, or Firm*—Harold Gell

[57] ABSTRACT

For the most distinctive technical application purposes and particularly for forming tubular hollow bodies which require a structural bulge, for instance for employment in heat exchangers where a stronger turbulence of the heat exchanger mediums and with it an improved heat exchange is achieved through structural bulges on the exchanger tube. The manufacture such tubular hollow bodies with structural bulges by means of mechanical arrangements are extremely labor intensive and therefore costly. According to the invention, a magnetic impulse provides a hollow body (2) with the desired structural bulges (7) which correspond to a support core in a shrinking process, or by an expansion process when the support core is removed. The hollow body (2) to be formed is preferably tubular. It is processed through an opening (3) in a magnetic field concentrator (1) in intermittent steps, a profiled support core (4) at the end of a carrying bar (6) is placed in the interior of the hollow body (2) and preferable projects into the opening (3) in the magnetic field concentrator (1). After a first ring-shaped array of structural bulges (7) is formed, the hollow body (2) is moved in a next work step and twisted around its axis so that a further magnetic impulse will form another array of structural bulge around the hollow body. Additional arrays of structural bulges are shaped as the hollow body is gradually moved and magnetic impulses are generated.

18 Claims, 2 Drawing Sheets

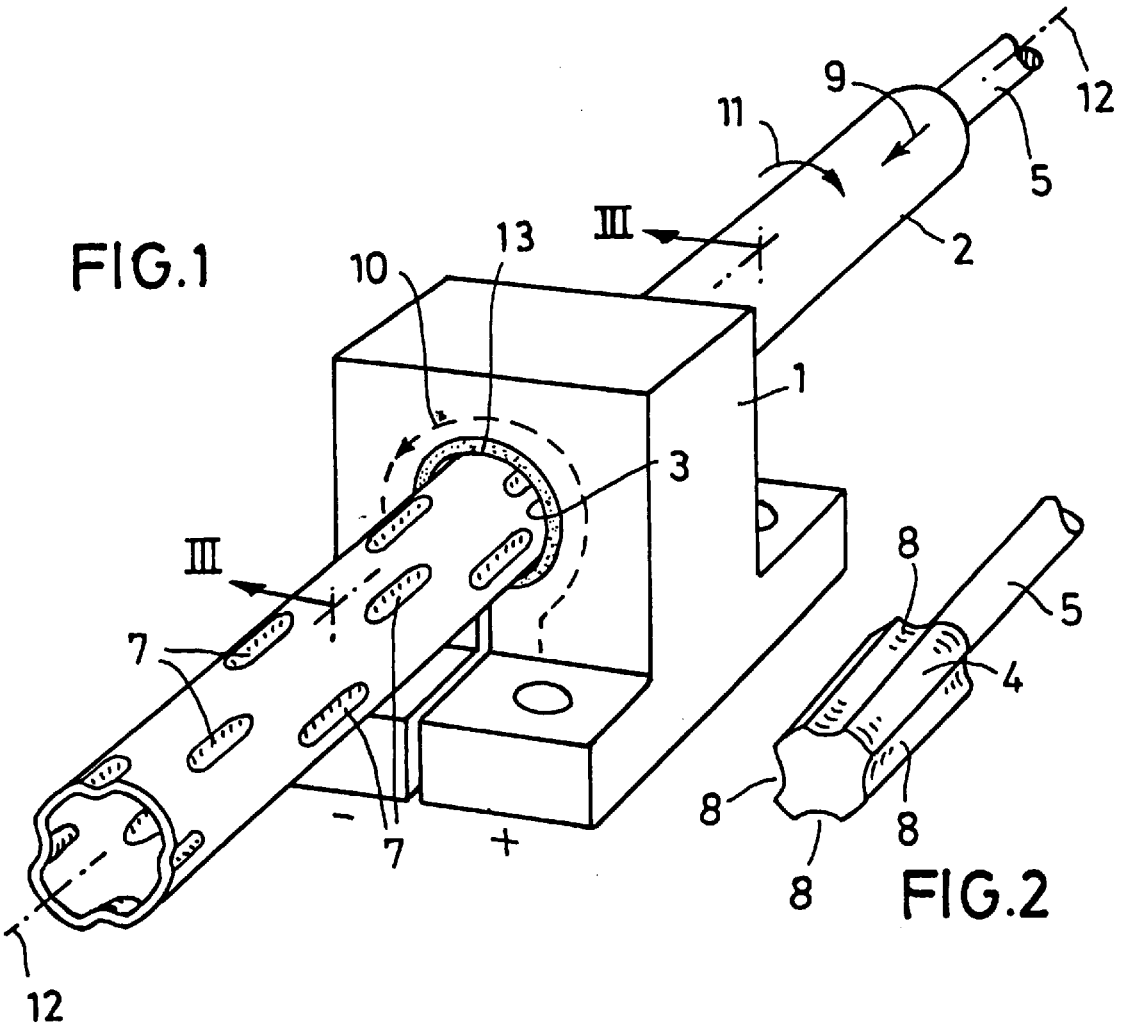
FIG.1
FIG.2
1
2
3
4
5
7
8
9
10
11
12
13
III
III
-
+
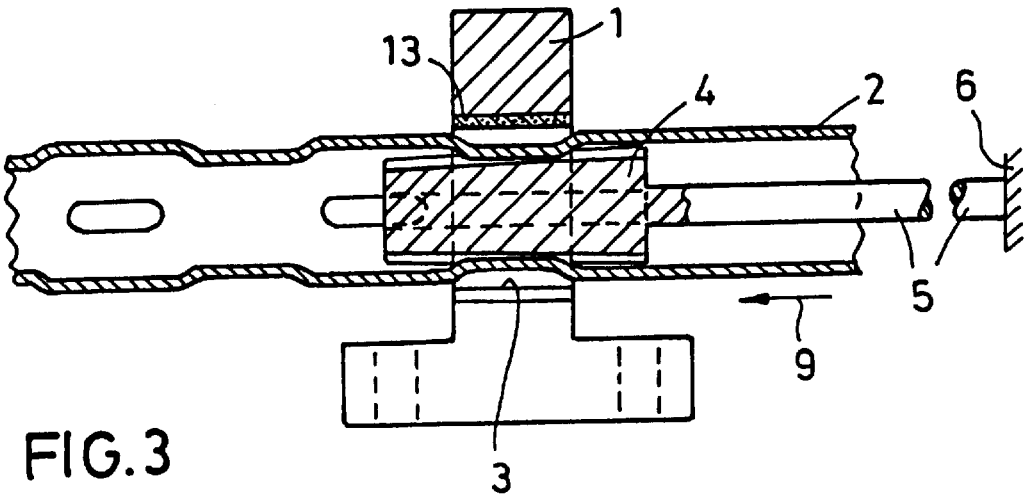
FIG.3
1
2
3
4
5
6
9
13

PROCESS AND APPARATUS FOR MANUFACTURING METALLIC HOLLOW BODIES WITH STRUCTURAL BULGES

BACKGROUND OF THE INVENTION

FIELD OF THE INVENTION

The invention comprises processes for manufacturing metallic hollow bodies with structural bulges and the apparatus for accomplishing such processes by way of a high current loop.

The reshaping of metallic work pieces by means of a magnetic impulse produced by a magnetic field concentrator is known.

Recently, a tubular hollow body with a structural bulge has been used for the most advanced technical application purposes in heat exchangers. For instance, through the use of a structural bulge a heat exchanger tube will develope a stronger turbulence of the heat exchanger mediums resulting in an improved heat transfer.

The manufacture such tubular hollow bodies with structural bulges by means of mechanical arrangements is extremely labor-intensive and therefore costly. Also, the deformation of tubular metallic hollow bodies to form structural bulges by means of a magnetic field concentrator offers considerable technical difficulties, particularly if the manufactured work pieces is to have a proportionate high production precision.

The present invention solves the task of creating a process for manufacturing metallic hollow bodies with structural bulges in a simple way by means of successive magnetic impulses applied to a hollow body to create uniformly formed structural bulges without shaping the processed work pieces in the area outside the structural bulge. This process distinguishes itself particularly through the employment of a simple and robust apparatus designed to accomplish the process.

This task is essentially solved according to the invention with a process for manufacturing metallic hollow bodies with structural bulges in that the hollow body is shrunk through the use of a magnetic impulse with the desired structural bulge corresponding to the shape of a support core or formed by expansion following removal of the support core.

In an advantageous process using the simplest preferred form of the invention, structural bulges are formed in a furnished hollow tubular body which is expediently guided through the metal forming opening in a magnetic field concentrator in intermittent processing steps. A profiled support core at the end of a carrying bar projects into the interior of the hollow body so it is within the opening in the magnetic field concentrator. The tubular hollow body is pulled over the support core and through the field concentrator which generates a first magnetic impulse around the hollow body to produce a structural bulge. The form of the structural bulge is determined by the grooves in the support core which proceed preferably in the longitudinal direction parallel to the common longitudinal axis of support core and the opening in the magnetic field concentrator.

After generating a first encircling, ring-shaped arrangement of structural bulges, the hollow body is pulled over the support core and through the magnetic field concentrator and twisted around its axis in a work step so that following a further magnetic impulse, a further encirclement of structural bulges is produced around the hollow body. Further encirclements of structural bulges are formed form from time to time during a gradual drawing back of the hollow body and by the generation of magnetic impulses.

SUMMARY OF THE INVENTION

The support core and its throat or grooves are reduced to a smaller scale in the direction of movement of the hollow body. The hollow body is removed from the gradual shaped conical support core so it can be brought to a new revised position.

Preferred examples for the complete implementation of advantageous forms of the invention and process are presented in the schematic drawings which show:

BRIEF DESCRIPTION OF THE DRAWINGS

FIG. 1 is a perspective view of a magnetic field concentrator and a metallic tubular hollow body that is being furnished with structural bulges, illustrated during a deformation process, FIG. 2 is a perspective view of the support core used to shape tubular hollow bodies by means of magnetic impulses, illustrated removed from the opening in the field concentrator, FIG. 3 is a longitudinal section through the apparatus with the field concentrator, support core and a hollow body to be shaped divided along the line III—III of FIG. 1., FIG. 4 shows a field concentrator with a rectangular opening for shaping the metallic hollow body with outside pointing structural bulges before the processing begins.

FIG. 5 shows a field concentrator shaping a hollow body with a magnetic impulse which brings up on the outside of the hollow body as directed by the magnetic powers received through the hollow body the desired structural bulges located on the outer surface, and FIG. 6 is a perspective view of a field concentrator with a metallic hollow body to be shaped by the field concentrator corners as it is moved gradually through the field concentrator opening in a multiple of steps and twisted after each movement so that magnetic impulses will produce successive encircling, outside pointing, structural bulges with successive bulge sets displaced from time to time around the hollow body at a certain angle.

DESCRIPTION OF THE PREFERRED EMBODIMENTS

Figure 4:
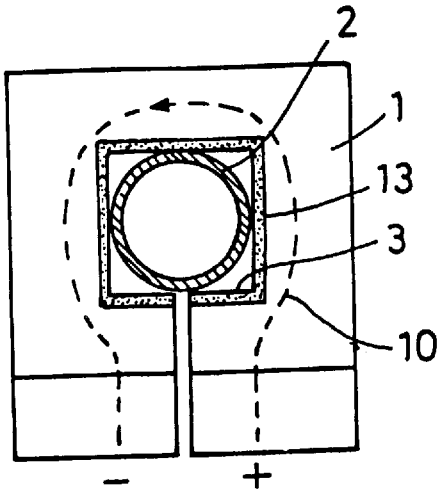
FIG. 4 through 6 illustrate the embodiment of FIGS. 1 through 3 with the apparatus modified to carry on the advantageous process of the invention for shaping the metallic hollow body with structural bulges springing outside the hollow body.

In the preferred embodiment of the invention, the process uses an apparatus composed of a field concentrator 1 with a rounded circle or multiple cornered opening 3 cross-section corresponding to the tubular hollow body to be shaped 2 and a support core 4 positioned in the opening. The support core 4 is placed at the end of a carrying bar 5 which is fastened to a machine stand 6.

As can be seen in FIGS. 1 through 3, the field concentrator 1 includes a cylindrical opening 3 in which is positioned a support core 4 for shaping hollow bodies 2 with inside directed, oblong structural bulges 7. The support core has a cross-sectional profile of round or multiple corners with several grooves 8 along its longitudinal axis and has an outer profile of the grooves 8 which is conically reduced in the direction of movement 9 of the hollow body to be shaped 2.

Similarly, field concentrators 1 can accommodate in the opening 3, support cores 4 with rounded or multiple cornered profiles with grooves 8 slanting or diagonal to its longitudinal axis. Support cores 4 that are so modified have an outside profile of the grooves 8 that is conically reduced in the direction of movement 9 of the hollow body 2 to be shaped.

Figure 5:
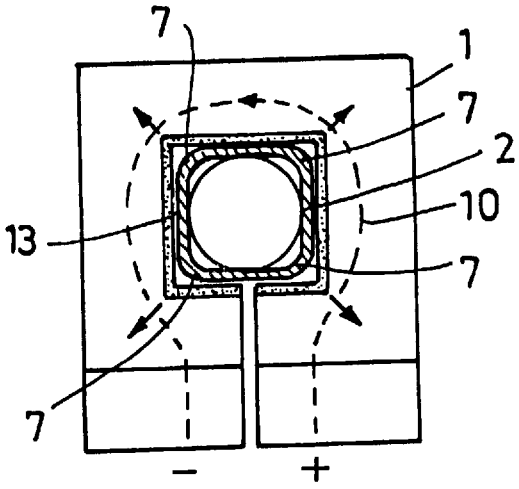
Figure 6:
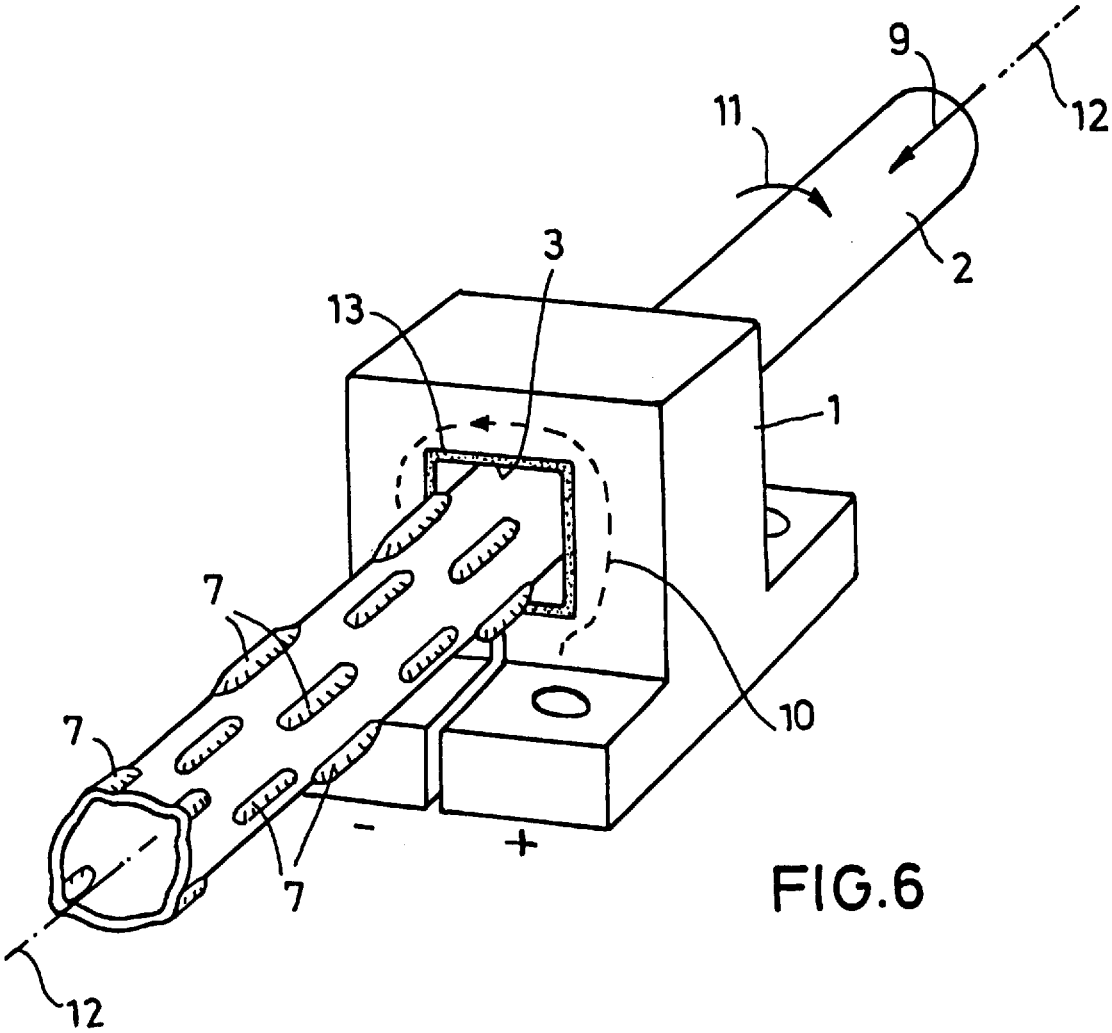

As shown in FIG. 4 through 6, the high current loop, which is the field concentrator 1, shapes the hollow body 2 by creating outside directed oblong bumps corresponding to the desired structural bulges 7. In this embodiment the cross-section of the opening 3 for the hollow body 2 is multiple cornered so that each magnetic impulse forces the wall the hollow body 2 into the corner regions of the opening 3. An internal support core is not necessary with this embodiment.

The magnetic impulse for shaping the metallic hollow body 2 is produced by the current 10 of a condenser discharge through an impulse transformer as described U.S. Pat. No. 5,684,341 and a field concentrator as described in U.S. Pat. No. 5,586,460.

In a modified embodiment of the apparatus, the magnetic impulse is produced by a field concentrator in the form of a field coil.

The process for manufacturing metallic hollow bodies 2 with structural bulges 7 is achieved by shaping the hollow body 2 with a magnetic impulse created by the apparatus illustrated in FIGS. 1 through 3 and/or FIGS. 4 through 6 with the desired structural bulge 7 corresponding to a support core in a shrinking process, or by an expansion process when a support core is removed.

As shown in FIGS. 1 through 3, in a first embodiment of the process the tubular hollow body 2 is gradually and/or intermittently moved in the longitudinal direction (arrow 9 in FIGS. 1 and 3) through the opening 3 in the field concentrator 1 and over the profile of the support core 4. Between individual movement steps, the field concentrator 1 produces a shaping magnetic impulse which forms the hollow body 2 on the support core 4.

The support core 4 is internally positioned in the hollow body 2 to be shaped with the grooves 8 proceeding along the length direction to be used and the outside profile of the grooves 8 is conically reduced in the movement direction 9 of the hollow body 2.

For manufacturing metallic hollow bodies 2 with oblong structural bulges 7 formed in the wall of the hollow body pointing out from the hollow body 2, as shown in FIGS. 4 through 6, the field concentrator 1 has an opening 3 which is multi-cornered according to the desired structural bulge 7 configuration through which the hollow body is gradual moved so that each magnetic impulse will drive the wall the hollow body 2 out into the corner regions of the opening 3.

FIGS. 1 through 3 and FIGS. 4 through 6 show the individual processes of shaping the metallic hollow body 2 with structural bulges 7. After each movement step over the support core 4 the hollow body 2 is rotated 11 around their common longitudinal axis 12 to such an extent that the next set of structural bulges 7 are displaced on the hollow body 2 reciprocally relative to the outer corners.

Instead of forming the hollow body 2 by first moving it axially over the support core 4 after each processing step and then turning it, it is also possible for the machine stand 6 to rotate the support core 4, after each forming and separation of the hollow body 2, by an angle amount so that successive sets of structural bulges 7 are displaced around the hollow body 2 reciprocally. The support core 4 can turn either intermittently in one direction or back and forth between two processing positions respectively. Between the individual rotations the hollow body 2 must be axially moved forward over the support core 4 to the next processing position.

The proceeding operations are not possible when the grooves 8 of the support core 4 are not in its longitudinal direction but slanting or diagonal to such an extent that at the metallic hollow body 2 is not parallel thereto and separation along the longitudinal axis 12 is prevented by the produced slanting or diagonal structural bulges 7. This requires that the hollow body 2 be not axial removed from the support core 4, but rather separated and removed in a kind of screw movement to bring it to the next processing position.

The inner surfaces of the opening 3 of the field concentrator 1 are covered in a known way with insulation 13 to avoid a short-circuit to performing work piece. If the parts have an isolating cover, the insulation 13 can eliminated from the field concentrator 1.

While preferred embodiments of this invention have been illustrated and described, variations and modifications may be apparent to those skilled in the art. Therefore, I do not wish to be limited thereto and ask that the scope and breadth of this invention be determined from the claims which follow rather than the above description.

What is claimed is:

1. A process for manufacturing hollow bulges in metallic hollow bodies, including the steps of:

placing a hollow body to be formed on a support core;

positioning said support core within said hollow body in an opening in a field concentrator;

forming inwardly projecting structural bulges in said hollow body by shrinking it around the profile of said support core by the application of a magnetic impulse;

moving said hollow body in a longitudinal direction through said opening in said field concentrator; and periodically producing magnetic impulses for effecting said step of forming said hollow body by shrinking it around said profile of said support core to thereby produce additional sets of structural bulges.

2. A process for manufacturing hollow bulges in metallic hollow bodies as defined by claim 1, wherein said step of moving said hollow body in a longitudinal direction through said opening in said field concentrator is accomplished as intermittent incremental movement steps; and said steps of periodically producing magnetic impulses occur between said intermittent incremental movement steps.

3. A process for manufacturing hollow bulges in metallic hollow bodies as defined by claim 1, including the step of relatively rotating said support core and said hollow body around their common longitudinal axis to such an extent that successive sets of said structural bulges are displaced around said hollow body.

4. A process for manufacturing hollow bulges in metallic hollow bodies as defined by claim 1, including the step of creating said magnetic impulse by discharging a condenser through an impulse transformer.

5. A process for manufacturing hollow bulges in metallic hollow bodies as defined by claim 1, including the step of creating said magnetic impulse with a field coil adapted to function as said field concentrator.

6. A process for manufacturing hollow bulges in metallic hollow bodies, including the steps of:

placing a hollow body to be formed in an opening in a field concentrator;

forming externally projecting structural bulges in said hollow body by expanding it into said opening in said field concentrator by the application of a magnetic impulse; and removing said hollow body from said opening in said field concentrator.

7. A process for manufacturing hollow bulges in metallic hollow bodies as defined by claim 6, including the steps of:

moving said hollow body in a longitudinal direction through said opening in said field concentrator; and periodically producing magnetic impulses for effecting said step of forming said hollow body by expanding it into said opening in said field concentrator by the application of a magnetic impulse to thereby produce additional sets of structural bulges.

8. A process for manufacturing hollow bulges in metallic hollow bodies as defined by claim 7, wherein said step of moving said hollow body in a longitudinal direction through said opening in said field concentrator is accomplished as intermittent incremental movement steps; and said steps of periodically producing magnetic impulses occur between said intermittent incremental movement steps.

9. A process for manufacturing hollow bulges in metallic hollow bodies as defined by claim 7, including the step of rotating said hollow body within said opening in said field concentrator around their common longitudinal axis to such an extent that successive sets of said structural bulges are displaced around said hollow body.

10. A process for manufacturing hollow bulges in metallic hollow bodies as defined by claim 6, including the step of creating said magnetic impulse by discharging a condenser through an impulse transformer.

11. A process for manufacturing hollow bulges in metallic hollow bodies as defined by claim 6, including the step of creating said magnetic impulse with a field coil adapted to function as said field concentrator.

12. An apparatus including a high current loop for metal forming by magnetic impulses, comprising:

a field concentrator;

a metal forming opening in said field concentrator for forming structural bulges in a hollow body;

a support core including grooves for providing a pattern about which said hollow body may be magniformed; and means for incrementally moving said hollow body relative to said support core whereby successive sets of said structural bulges are created by successive ones of said magnetic impulses.

13. An apparatus including a high current loop for metal forming by a magnetic impulse as defined by claim 12, wherein said support core has a rounded cross-sectional profile.

14. An apparatus including a high current loop for metal forming by a magnetic impulse as defined by claim 12, wherein said support core has a multiple cornered cross-sectional profile.

15. An apparatus including a high current loop for metal forming by a magnetic impulse as defined by claim 12, wherein said grooves in said support core are parallel to the longitudinal axis of said support core.

16. An apparatus including a high current loop for metal forming by a magnetic impulse as defined by claim 12, wherein said grooves in said support core are at a diagonal to the longitudinal axis of said support core.

17. An apparatus including a high current loop for metal forming by a magnetic impulse as defined by claim 12, wherein said support core has a conical outside profile which is reduced in the direction of longitudinal movement after magneforming of said hollow body.

18. An apparatus including a high current loop for metal forming by a magnetic impulse, comprising:

a field concentrator;

a metal forming opening in said field concentrator for forming structural bulges in a the hollow body; and said metal forming opening in said field concentrator configure with a multiple cornered cross section with corners corresponding to the structural bulges desired on said hollow body for forming outside directed structural bulges on said hollow body.

* * * * *